US011035177B2

(12) United States Patent
Dubose et al.

(10) Patent No.: US 11,035,177 B2
(45) Date of Patent: Jun. 15, 2021

(54) SHAPED CUTTERS

(71) Applicant: Ulterra Drilling Technologies, L.P., Fort Worth, TX (US)

(72) Inventors: William Henry Dubose, Irving, TX (US); Brady Walters, Weatherford, TX (US); Christopher M. Casad, Benbrook, TX (US); Josh Criswell, Carrollton, TX (US)

(73) Assignee: Ulterra Drilling Technologies L.P., Fort Worth, TX (US)

( * ) Notice: Subject to any disclaimer, the term of this patent is extended or adjusted under 35 U.S.C. 154(b) by 297 days.

(21) Appl. No.: 16/249,827

(22) Filed: Jan. 16, 2019

(65) Prior Publication Data

US 2020/0224501 A1 Jul. 16, 2020

(51) Int. Cl.

| | |
|---|---|
| ***E21B 10/56*** | (2006.01) |
| ***E21B 10/567*** | (2006.01) |
| *E21B 10/55* | (2006.01) |

(52) U.S. Cl.

CPC ..... *E21B 10/5673* (2013.01); *E21B 10/56* (2013.01); *E21B 10/567* (2013.01); *E21B 10/55* (2013.01)

(58) Field of Classification Search

CPC ..... E21B 10/56; E21B 10/567; E21B 10/5673
See application file for complete search history.

(56) References Cited

U.S. PATENT DOCUMENTS

| | | | | |
|---|---|---|---|---|
| 9,140,072 | B2 * | 9/2015 | Nelms | E21B 10/5735 |
| 2013/0068537 | A1 * | 3/2013 | DiGiovanni | E21B 10/5735 175/430 |
| 2020/0157890 | A1 * | 5/2020 | Cuillier De Maindreville | E21B 10/55 |
| 2020/0224500 | A1 * | 7/2020 | Dubose | E21B 10/5673 |
| 2020/0347680 | A1 * | 11/2020 | Tian | E21B 10/5676 |

* cited by examiner

*Primary Examiner* — Tara Schimpf
(74) *Attorney, Agent, or Firm* — Kilpatrick Townsend & Stockton LLP

(57) ABSTRACT

Embodiments of the present invention provides cutting elements for use on rotary drill bits for drilling subterranean formations. More specifically, the present disclosure relates to cutting elements having a shaped upper surface including at least one spoke for cutting and/or failing subterranean formations during drilling. The present disclosure also relates to drill bits incorporating one or more of such cutting elements.

31 Claims, 6 Drawing Sheets

SHAPED CUTTERS

FIELD OF THE DISCLOSURE

The present disclosure generally relates to cutting elements for use on rotary drill bits for drilling subterranean formations. More specifically, the present disclosure relates to cutting elements having a shaped upper surface including at least one spoke for cutting and/or failing subterranean formations during drilling. The present disclosure also relates to drill bits incorporating one or more of such cutting elements.

BACKGROUND

Rotary drill bits are often used to drill a variety of subterranean formations. Different types of rotary drill bits are known in the art including, e.g., fixed-cutter bits (which are often referred to as "drag bits"), rolling-cutter bits (which are often referred to in the art as "rock bits"), diamond-impregnated bits, and hybrid bits, e.g., both fixed cutters and rolling cutters. Generally, rotary drill bits include cutting elements attached to the bit body. During operation, the drill bit is rotated and advanced into the subterranean formation. As the drill bit rotates, the cutting elements cut, crush, shear, and/or abrade away the formation material to form a wellbore in the subterranean formations.

Many cutting elements having superhard cutting faces suffer from cracking, spalling, chipping and partial fracturing of the cutting surface at a region of the cutting element subjected to the highest load during drilling, e.g., the critical region. The critical region encompasses the portion of the cutting surface that makes contact with the subterranean formation during drilling. The critical region is subjected to high magnitude stresses from dynamic normal loading, and shear loadings imposed on the cutting face of the cutting element during drilling. Because cutting elements are typically inserted into a drag bit at a rake angle, the critical region includes a portion of the superhard surface near and including a portion of the layer's circumferential edge that makes contact with the subterranean formations during drilling.

The high magnitude stresses at the critical region alone or in combination with other factors, such as residual thermal stresses, can result in the initiation and growth of cracks across the cutting face of cutting elements. Cracks may cause the separation of a portion of the cutting face, rendering the cutting element ineffective or resulting in cutting element failure. When this happens, drilling operations may have to cease to allow for recovery of the drag bit and for replacement of the ineffective or failed cutting element. The high stresses, particularly shear stresses, can also result in delamination of the ultrahard layer at the interface.

Thus, the need exists for cutting elements that can withstand high loading at the critical region imposed during drilling to improve operating life. Additionally, the need exists for cutting elements that cut efficiently at designed speed and loading conditions to regulate the amount of cutting load in changing formations. The need also exists for improved drill bit stability.

BRIEF SUMMARY

In some embodiments, the present disclosure relates to a cutting element, the cutting element comprising: a substantially cylindrical substrate; a superabrasive table positioned on the cylindrical substrate, the superabrasive table comprising: a cutting face having a substantially planar portion surrounding a central recess, the planar portion extending laterally to an outer circumferential edge; and at least one spoke disposed on the cutting face, the spoke extending radially from a periphery of the recess to the outer circumferential edge. In some aspects, each spoke comprises an upper surface having an interior region adjacent the periphery of the recess and an outer region adjacent the edge of the cutting face, wherein the upper surface has an upper surface width that decreases from the interior region to the outer region. In some aspects, the spoke is raised in relation to the planar portion of the cutting face. In some aspects, the spoke comprises an interior region adjacent the periphery of the recess and an outer region adjacent the edge of the cutting face, wherein the spoke has a height that increases from the interior region to the outer region, and wherein the spoke has a maximum height at the outer region. In some aspects, the spoke comprises an interior region adjacent the periphery of the recess, an outer region adjacent the edge of the cutting face, and an upper lateral spoke surface extending therebetween, wherein the spoke comprises sidewalls on opposing sides of the upper lateral spoke surface, each of the sidewalls extending from the upper lateral spoke surface to the planar portion of the cutting face. In some aspects, each of the sidewalls are transverse relative to the upper lateral spoke surface of the spoke and the planar portion of the cutting face, wherein each sidewall increases in height from the interior region to the outer region. In some aspects, the cutting element comprises at least four spokes equidistantly spaced on the cutting face, wherein the planar portion is divided into four separate planar portions, each pair of adjacent spokes being separated by a respective planar portion. In some aspects, the recess is substantially circular and is defined by a laterally extending convex surface and a longitudinally extending circumferential side wall. In some aspects, the superabrasive table comprises a chamfered region between the edge of the cutting face and a sidewall of the cylindrical substrate.

In some embodiments, the present disclosure relates to a cutting element, the cutting element comprising: a substantially cylindrical substrate; a superabrasive table positioned on the cylindrical substrate, the superabrasive table comprising: a cutting face having a substantially planar central region and an outer circumferential cutting edge; a plurality of spokes extending radially outward from the central region to the edge of the cutting face, wherein each spoke comprises an interior region adjacent the central region, an outer region adjacent the edge of the cutting face, and an upper surface extending therebetween, wherein a ratio of an upper surface width at the interior region to the upper surface width at the outer region ranges from 0.5:1 to 2:1; and a plurality of depressions, each depression extending between adjacent spokes and from a periphery of the central region to the outer circumferential cutting edge of the cutting face. In some aspects, the upper surface of each spoke is substantially co-planar and continuous with the central region. In some aspects, the upper surface of each spoke has a width that is substantially constant from the interior region to the outer region. In some aspects, the upper surface of each spoke has a width that decreases from the interior region to the outer region. In some aspects, each depression has a depth that increases from an interior radial region to an outer radial region, wherein each depression merges with the cutting edge. In some aspects, each depression merges with a portion of one or more spokes at the interior region adjacent the central region. In some aspects, the cutting face does not include a substantially planar outer lateral circumferential portion adjacent the cutting edge of the cutting face. In some aspects, each spoke increases in height from the interior region to the outer region, wherein the spoke has a maximum height at the outer region. In some aspects, each spoke includes sidewalls on opposing sides of the upper surface, each of the sidewalls extending from the upper surface to the depression. In some aspects, each sidewall extends from the upper surface to the depression of an associated spoke at a transverse angle. In some aspects, the cutting element comprises at least four spokes equidistantly spaced on the cutting face, wherein each of the at least four spokes are symmetrically arranged on the cutting face, wherein each of the at least four spokes are continuous and co-planar with the central region. In some aspects, the upper surface has a minimum upper surface width in an intermediate region between the central region and the outer region. In some aspects, an interior region of each depression forms an angle ranging from 45° to 180° between adjacent spokes. In some aspects, each depression has a depth that is constant or decreases from an interior radial region to an outer radial region. In some aspects, the cutting face includes a substantially planar outer lateral circumferential portion adjacent the cutting edge of the cutting face. In some aspects, each spoke comprises an interior region adjacent the central region, an outer region adjacent the edge of the cutting face, and an upper surface extending therebetween, wherein the upper surface has a minimum upper surface width in an intermediate region between the central region and the outer region.

In some embodiments, the present disclosure relates to a cutting element, the cutting element comprising a superabrasive table positioned on the cylindrical substrate, the superabrasive table comprising: an asymmetric cutting face having a substantially planar central region and an outer circumferential cutting edge; a plurality of spokes extending radially outward from the central region to the edge of the cutting face, each spoke comprises an interior region adjacent the central region, an outer region adjacent the cutting edge of the cutting face, and an upper surface extending therebetween, wherein each spoke includes sidewalls on opposing sides of the upper surface; and a plurality of depressions, each depression extending between adjacent spokes and from a periphery of the central region to the outer circumferential cutting edge of the cutting face. In some aspects, each spoke has a leading sidewall and a trailing sidewall and, when taken in the clockwise direction, the leading sidewall has a shorter length than the trailing sidewall. In some aspects, each spoke has a leading sidewall and a trailing sidewall and, when taken in the clockwise direction, the leading sidewall has a longer length than the trailing sidewall. In some aspects, the sidewalls of each of the spokes are not mirror images of each other. In some aspects, at least one of the sidewalls is convex. In some aspects, at least one of the sidewalls is concave. In some aspects, the upper surface of each spoke is substantially co-planar continuous with the central region. In some aspects, the cutting element comprises at least four spokes spaced apart on the cutting face, wherein each of the at least four spokes are continuous and co-planar with the central region.

DETAILED DESCRIPTION

Introduction

Figure 1:
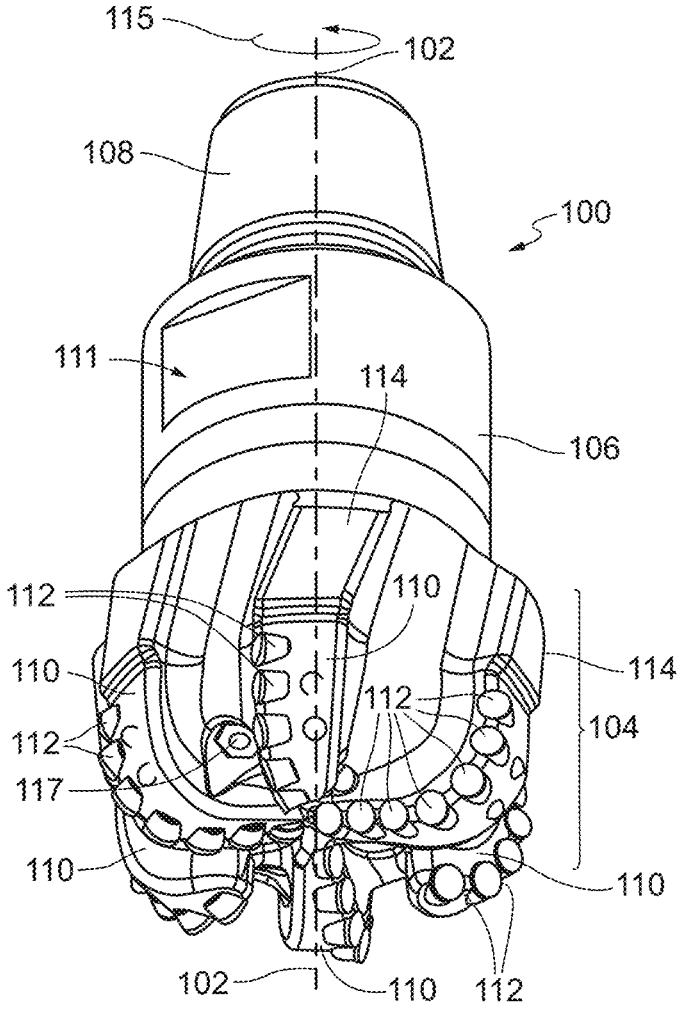
FIG. 1 shows a perspective view of a rotary drill bit including cutting elements according to embodiments of the present disclosure.

The present disclosure relates to cutting elements having shaped cutting surfaces that can withstand high loading at the critical region during drilling thereby enhancing operating life. The shaped cutting elements provide a relatively high rate of penetration and increased depth of drilling, while at the same time minimizing the effects of wear and the tendency for breakage of the cutting element. In particular, the orientation and placement of the individual cutting elements on the rotary drill bit can improve the rate of penetration, speed, and loading conditions, and can compensate for the amount of cutting load in changing formations. For example, the cutter profile, e.g., the exposure of the cutting element as well as the back rake and side rake of the cutting element on the rotary drill bit, have been found to significantly contribute to increased drilling depth before failure of one or more cutting elements. Additionally, the shaped cutter surfaces have substantially improved impact resistance, abrasion resistance and hydraulic efficiency during drilling.

The inventors have found that cutting elements with sharp cutting edges or small back rake angles provide a high rate of penetration ("ROP"), but are often subject to instability and are susceptible to chipping, cracking or partial fracturing when subjected to high forces normal to the working surface. For example, large forces can be generated when the cutter digs or gouges deep into a formation or when sudden changes in formation hardness produce sudden impact loads. Small back rake angles also tend to exhibit less delamination resistance when subjected to shear load. Cutters with large back rake angles, in contrast, are often subjected to heavy wear, abrasion and shear forces resulting in chipping, spalling, and delaminating due to excessive downward force or "weight on bit" (WOB) required to obtain reasonable ROP. Thick ultrahard layers may provide abrasion wear, but are often susceptible to cracking, spalling, and delaminating as a result of residual thermal stresses associated with forming thick ultrahard layers on the substrate. The susceptibility to such deterioration and failure mechanisms is accelerated when combined with excessive load stresses.

The inventors have discovered that using cutting elements with shaped cutting surfaces, as described herein, can better withstand high loading at the critical region during drilling to enhance operating life. The cutters with shaped working surfaces can cut efficiently at designed speed, penetration, and loading conditions, and can compensate for the amount of cutting load in changing formations. The shaped cutting surfaces have been found to contribute to reduced chipping, cracking or partial fracturing when subjected to high forces normal to the working surface in response to increased cutting depth. Additionally, the inventors have found that the shaped cutter surfaces provide efficient chip removal and increased stability to provide selectable cutting characteristics for different locations on the rotary drill bit.

As used herein, the phrase "rotary drill bits" or "drill bit" refers generally to any type of drilling tool, e.g., drag bits, roller cone bits, hybrid bits (e.g., including both fixed cutters and roller elements), coring bits, percussion bits, bi-center bits, reamers, and other so-called "hole-opening" tools. It is contemplated that the cutting elements described herein can be used in conjunction with any type of rotary drill bit that is used to cut or otherwise remove formation material to form or enlarge a bore in the formation.

Rotary Drill Bit

FIG. 1 illustrates an example of a rotary drill bit 100 according to embodiments of the present disclosure. The rotary drill bit 100 of FIG. 1 is intended to be a representative example of drill bits, e.g., drag bits, for drilling formations. The rotary drill bit 100 is designed to be rotated around its central axis 102. The drill bit comprises a bit body 104 connected to a shank 106 having a tapered threaded coupling 108 for connecting the bit to a drill string (not shown). The drill bit may further include a bit breaker surface 111 for cooperating with a wrench to tighten and loosen the coupling to the drill string. The exterior surface of the bit body 104 is intended to face generally in the direction of boring and is referred to as bit face. The face generally lies in a plane perpendicular to the central axis 102 of the bit. The bit body 104 is not limited to any particular material. In some embodiments, the bit body 104 comprises steel or a matrix material, e.g., powdered tungsten carbide cemented by metal binder.

During drilling operation, the rotary drill bit 100 may be coupled to the drill string. As the rotary drill bit 100 is rotated within the wellbore via the drill string, drilling fluid may be pumped down the drill string, through the internal fluid plenum and fluid passageways within the bit body 104 of the rotary drill bit 100, and out from the rotary drill bit 100 through nozzles 117. Formation cuttings generated by the cutting elements of the bit body 104 may be carried with the drilling fluid through the fluid courses (e.g., "junk slots"), around the rotary drill bit 100, and back up the wellbore through the annular space within the wellbore outside the drill string.

The bit body 104 may include a plurality of raised blades 110 that extend from the face of the bit body 104. In some embodiments, the plurality of blades 110 extend radially along the bit face and are circumferentially spaced structures extending along the leading end or formation engaging portion of the bit body 104. Each blade 110 may extend generally in a radial direction, outwardly to the periphery of the bit body 104. For example, the blades 110 may generally extend from the cone region proximate the longitudinal axis, or central axis 102, of the bit, upwardly to the gage region, or maximum drill diameter of bit. In some embodiments, the blades 110 are substantially equally spaced around the central axis 102 of the bit and each blade 110 sweeps or curves backwardly in the direction of rotation indicated by arrow 115.

The bit body 104 further includes a plurality of superabrasive cutting elements 112, e.g., polycrystalline diamond compact ("PDC") cutting elements, disposed on radially outward facing surfaces of each of the blades 110. For example, a plurality of discrete cutting elements 112 may be mounted on each blade 110. Each discrete cutting element 112 may be disposed within a recess or pocket in each blade 110. The cutting elements 112 may be mounted to a rotary drill bit 100 either by press-fitting or otherwise locking the stud (e.g., substrate portion of cutting element) of the cutting elements 112 into a receptacle on a drag bit, or by brazing a portion of the cutting elements 112 directly into a preformed pocket, socket or other receptacle on the face of a bit body 104.

Cutting elements 112 used in rotary drill bits are often PDC cutting elements. It has been known in the art that PDC cutters perform well on drag bits. PDC cutting elements include a polycrystalline diamond (PCD) material, which may be characterized as a superabrasive or superhard material. Such polycrystalline diamond materials are formed by sintering and bonding together small diamond grains (e.g., diamond crystals), under conditions of high temperature and high pressure, in the presence of a catalyst material to form polycrystalline diamond.

In the rotary drill bit 100, the cutting elements 112 may be placed along the forward (in the direction of intended rotation) side of the blades 110, with their working surfaces facing generally in the forward direction for shearing the earth formation when the rotary drill bit 100 is rotated about its central axis 102. In some embodiments, the blade 110 may comprise one or more rows of cutting elements 112 disposed on the blade 110. For example, the blade 110 may comprise a first row of primary cutters and a second row of backup cutters. A plurality of primary cutting elements may be mounted side-by-side along each blade. The secondary cutting elements may be mounted rearwardly from the primary cutters on the blade 110. The secondary cutting elements may rotationally follow the primary cutters at selected back rake and side rake angle. For example, the secondary cutting elements may be spaced rearwardly from the primary cutting elements to cut or abrade a kerf region formed between adjacent primary cutters. In some embodiments, at least one of the cutting elements, e.g., a secondary cutter, is clocked relative to a kerf region formed by a rotationally preceding cutter, e.g., a primary cutter. As used herein, clocked refers to aligning a spoke of the cutting element with a kerf region.

In some aspects, the secondary cutting elements may be mounted on another blade 110 from the primary cutters. Although the figures only show a few secondary cutting elements mounted on each blade 110, any number of the primary cutting elements may be provided with an associated secondary cutting element. As well known in the art, cutting elements 112 are radially spaced such that the groove or kerf formed by cutting elements 112 overlaps to a degree with kerfs formed by one or more cutting elements 112 in other rows.

In some aspects, the secondary cutting element may lie at the same radial distance from the axis of rotation of the bit as its associated primary cutting element. In the example shown in FIG. 1, the cutters are arranged along blades to form a structure cutting or gouging the formation and then pushing the resulting debris into the drilling fluid which exits the rotary drill bit 100 through the nozzles 117. The drilling fluid in turn transports the debris or cuttings uphole to the surface.

In some embodiments, the cutting elements 112 may comprises PDC cutters. However, in other embodiments, not all of the cutters need to be PDC cutters. The PDC cutters in this example have a working surface made primarily of super hard, polycrystalline diamond, or the like, supported by a substrate that forms a mounting stud for placement in a pocket formed in the blade 110. In some embodiments, each of the PDC cutters is fabricated discretely and then mounted—by brazing, press fitting, or otherwise into pockets formed on bit. This example of a drill bit includes gage pads 114. In some applications, the gauge pads of drill bits such as rotary drill bit 100 can include an insert of thermally stable, sintered polycrystalline diamond (TSP).

Generally, each blade 110 includes a cone region, a nose region, a shoulder region, and a gage region. Fluid ports are disposed about the face of the bit body 104 and are in fluid communication with at least one interior passage provided in the interior of bit body. In some aspects, fluid ports include nozzles 117 disposed therein to better control the expulsion of drilling fluid from bit body into fluid courses and junk slots in order to facilitate the cooling of cutters on bit and the flushing of formation cuttings up the borehole toward the surface when bit is in operation.

In some embodiments, the cutting elements 112 are embedded or mounted on the blades at a selected back rake and a selected side rake depending on their location on the blade 110. The cutting elements 112 may be strategically located on the respective blades 110 in desired forward sweep, back rake and side rake configurations to facilitate optimum cutting efficiency and channeling of drilling fluid pumped through the rotary drill bit 100 around the blades 110 and cutting elements 112 to clear the cutting elements 112 of formation cuttings in an optimal manner.

As mentioned, the back rake and side rake of each cutting element may be dependent on the location of the cutting element on the blade. In some aspects, the back rake of the cutting element(s) in the cone region ranges from 5° to 45°, e.g., from 10° to 40°, from 15° to 35°, or from 20° to 30°. In terms of upper limits, the back rake of the cutting element(s) in the cone region is less than 45°, e.g., less than 40°, less than 30°, or less than 20°. In terms of lower limits, the back rake of the cutting element(s) in the cone region is greater than 5°, e.g., greater than 10°, greater than 15°, or greater than 18°. In some aspects, the side rake of the cutting element(s) in the cone region ranges from 0° to 10°, e.g., from 1° to 9°, from 2° to 8°, or from 4° to 6°. In terms of upper limits, the side rake of the cutting element(s) in the cone region is less than 10°, e.g., less than 8°, less than 6°, or less than 5°. In terms of lower limits, the side rake of the cutting element(s) in the cone region is greater than 0°, e.g., greater than 1°, greater than 2°, or greater than 4°.

In some aspects, the back rake of the cutting element(s) in the nose region ranges from 10° to 30°, e.g., from 12° to 28°, from 15° to 25°, or from 18° to 22°. In terms of upper limits, the back rake of the cutting element(s) in the nose region is less than 30°, e.g., less than 28°, less than 25°, or less than 22°. In terms of lower limits, the back rake of the cutting element(s) in the nose region is greater than 10°, e.g., greater than 12°, greater than 15°, or greater than 18°. In some aspects, the side rake of the cutting element(s) in the nose region ranges from 5° to 20°, e.g., from 6° to 18°, from 7° to 16°, or from 8° to 14°. In terms of upper limits, the side rake of the cutting element(s) in the nose region is less than 20°, e.g., less than 18°, less than 15°, or less than 12°. In terms of lower limits, the side rake of the cutting element(s) in the nose region is greater than 5°, e.g., greater than 6°, greater than 7°, or greater than 8°.

In some aspects, the back rake of the cutting element(s) in the shoulder region ranges from 10° to 30°, e.g., from 12° to 28°, from 15° to 25°, or from 18° to 22°. In terms of upper limits, the back rake of the cutting element(s) in the shoulder region is less than 30°, e.g., less than 28°, less than 25°, or less than 22°. In terms of lower limits, the back rake of the cutting element(s) in the shoulder region is greater than 10°, e.g., greater than 12°, greater than 15°, or greater than 18°. In some aspects, the side rake of the cutting element(s) in the shoulder region ranges from 5° to 20°, e.g., from 6° to 18°, from 7° to 16°, or from 8° to 14°. In terms of upper limits, the side rake of the cutting element(s) in the shoulder region is less than 20°, e.g., less than 18°, less than 15°, or less than 12°. In terms of lower limits, the side rake of the cutting element(s) in the shoulder region is greater than 5°, e.g., greater than 6°, greater than 7°, or greater than 8°.

In some aspects, the back rake of the cutting element(s) in the gage region ranges from 15° to 50°, e.g., from 20° to 45°, from 25° to 40°, or from 30° to 35°. In terms of upper limits, the back rake of the cutting element(s) in the gage region is less than 50°, e.g., less than 45°, less than 40°, or less than 35°. In terms of lower limits, the back rake of the cutting element(s) in the gage region is greater than 15°, e.g., greater than 20°, greater than 25°, or greater than 30°. In some aspects, the side rake of the cutting element(s) in the gage region ranges from 0° to 10°, e.g., from 1° to 9°, from 2° to 8°, or from 4° to 6°. In terms of upper limits, the side rake of the cutting element(s) in the gage region is less than 10°, e.g., less than 8°, less than 6°, or less than 5°. In terms of lower limits, the side rake of the cutting element(s) in the gage region is greater than 0°, e.g., greater than 1°, greater than 2°, or greater than 4°.

The cutting elements 112 may have cutting faces having the same general shape, or the cutting elements 112 may have various shapes. The cutting faces of the elements may also differ in size according to their position on the blade 110 of the rotary drill bit 100. Additionally, cutting elements 112 may have differing cutting profiles, e.g., exposure heights, such that those elements extending further from the bit face are more exposed (e.g., high profile) to the formation material than those which are mounted at a relatively lower height (e.g., low profile) from the bit face. In some embodiments, cutting elements have a limited amount of exposure generally perpendicular to the selected portion of the formation-facing surface in which the superabrasive cutter is secured to control the effective depth-of-cut of at least one superabrasive cutter into a formation when the bit is engaging a formation during drilling.

In some embodiments, the cutting elements 112 having the smallest cutting face, as measured by surface contact surface area, will generally be mounted so as to have the greatest exposure to the formation, while the cutting elements having the largest cutting face will have the least exposure to the formation. This arrangement increases the stability of the bit by creating relatively tall and sharply tapered ridges between the kerfs which provide the side forces helpful in resisting bit vibration. The most exposed cutters may either have more or less negative back rake relative to the other cutters as dependent upon the type of formation being cut.

Shaped Cutters

Figure 2A:
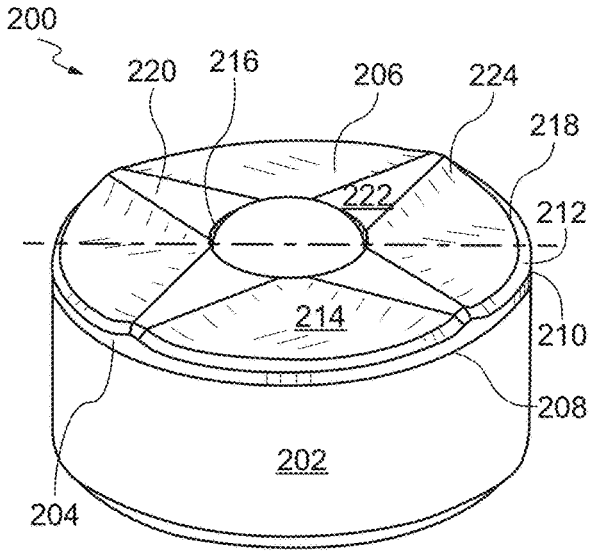
FIG. 2A shows a perspective view of a cutting element according to embodiments of the present disclosure.

FIG. 2A is a perspective view of a cutting element 200 according to one embodiment of the present disclosure. The cutting element 200 includes a cutting element substrate 202 having a superabrasive table 204 thereon. The superabrasive table 204 may comprise a superabrasive material, e.g., a PCD material, having a cutting face 206. In some aspects, superabrasive materials may comprise natural diamond, synthetic diamond, cubic boron nitride, diamond-like carbon materials, or combinations thereof. In some aspects, the cutting element 200 includes a diamond table 204. The cutting element substrate 202 may have a generally cylindrical shape as shown in FIG. 2A.

The superabrasive table 204 may be formed or mounted on the cutting element substrate 202. In some aspects, the cutting element substrate 202 and the superabrasive table 204 may be distinct and separate components. That is, the cutting element substrate 202 and the superabrasive table 204 may separately formed and subsequently attached together. The cutting element substrate 202 may comprise a material that is relatively hard and resistant to wear, or may comprise the same material as the superabrasive table 204. For example, the cutting element substrate 202 may comprise a ceramic-metal composite material, e.g., cermet. In some aspects, the cutting element substrate 202 may include a cemented carbide material, such as a cemented tungsten carbide material, in which tungsten carbide particles are cemented together in a metallic binder material. The metallic binder material may include, for example, cobalt, nickel, iron, or alloys and mixtures thereof.

The cutting element 200 may be a PDC cutter. The PDC cutter may be formed by placing a substrate, e.g., a sintered carbide substrate, into the container of a press. A mixture of diamond grains or diamond grains and catalyst binder is placed atop the substrate and treated under high pressure, high temperature conditions. In doing so, metal binder migrates from the substrate and passes through the diamond grains to promote intergrowth between the diamond grains. As a result, the diamond grains become bonded to each other to form the diamond layer, and the diamond layer is in turn integrally bonded to the substrate. The substrate often comprises a metal-carbide composite material, such as tungsten carbide-cobalt. The deposited diamond layer is often referred to as the "diamond table" or "abrasive layer."

In some aspects, the cutting element substrate 202 may comprise two layers, including a layer immediately supporting the superabrasive table 204, which may be formed and bonded to another piece of like diameter. In some aspects, the layers of the superabrasive table 204 may comprise the same material or may comprise different materials. In any case, the cutting elements 200 may be secured in pockets on blades 110, e.g., by brazing, as depicted in FIG. 1.

An interface 208 may be defined between the cutting element substrate 202 and superabrasive table 204. The interface 208 between the cutting element substrate 202 and superabrasive table 204 may be substantially planar. The term "substantially planar" should also be understood to encompass cutting elements 200 having grooved, ridged or other non-planar interfaces between the superabrasive table 204 and the supporting substrate 202. For example, the surface of the cutting element substrate 202 in contact with the superabrasive table 204 may include one or more concave or convex portions. In this example, the surface of the superabrasive table 204 that contacts the surface of the cutting element substrate 202 may include a corresponding concave or convex portion to form a press-fit.

In some aspects, the superabrasive table 204 may have a chamfered edge 210. The chamfered edge 210 may be interposed between the cutting face 206 and the side of the superabrasive table 204. The chamfered edge 210 of the superabrasive table 204 shown in FIG. 2A has a single chamfer surface 212. In some embodiments, the chamfered edge 210 also may have additional chamfer surfaces. The additional chamfer surfaces may be oriented at chamfer angles that differ from the chamfer angle of the chamfer surface 212. In some embodiments, one or more edge portions, e.g., arcuate edges, may be employed in lieu of, or in addition to, one or more chamfered surfaces at a peripheral edge of the superabrasive table 204.

Figure 2B:
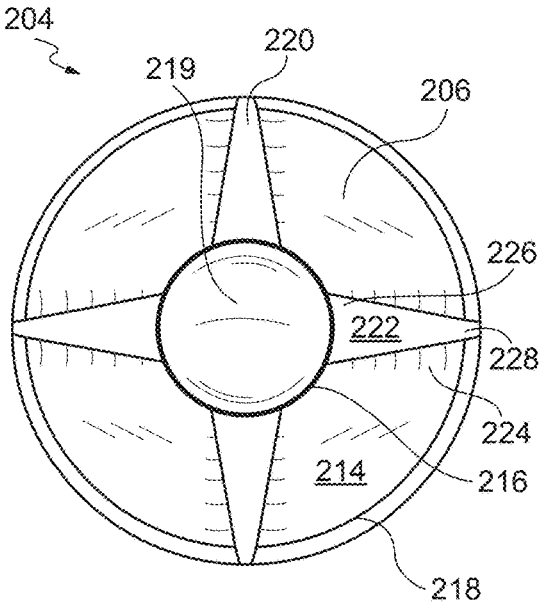
FIG. 2B shows a top plan view of the cutting element of FIG. 2A according to embodiments of the present disclosure.

The superabrasive table 204 positioned on the cutting element substrate 202 includes a cutting face 206 distal to the cutting element substrate 202. The cutting face 206 includes at least one substantially planar portion 214 surrounding or adjacent to a recess 216. As shown in FIG. 2B, the recess 216 may be located at central region of the cutting face 206, e.g., at or proximate to the longitudinal centerline of the cutting element 200. The planar portion 214 extends laterally from the periphery of the recess 216 to an outer circumferential edge 218 of the cutting face 206. The recess 216 can be a recessed center region that reduces cross-face cracking.

Figure 2C:
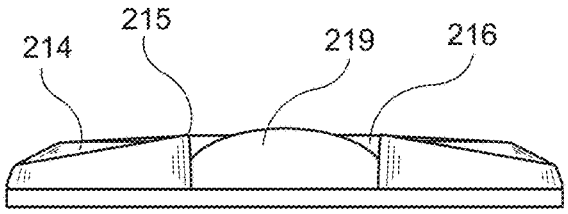
FIG. 2C shows a partial cross-sectional view of a superabrasive table of the cutting element of FIG. 2A along line A showing a profile of a radial spoke relative to planar depression on the cutting face, according to embodiments of the present disclosure.

In some aspects, the planar portion 214 is transverse to the longitudinal centerline of the cutting element 200. For example, FIG. 2C shows a cross-sectional profile of a planar portion 214 relative to the recess 216. The planar portion 214 may extend radially from a region 215 adjacent the central recess 216 at a sloped downward angle to the outer circumferential edge 218 of the cutting face 206. In some aspects, the planar portion 214 may have a maximum height at a region 215 adjacent the central recess 216. The planar portion 214 may be at an angle ranging from 0° to 90°, relative to the centerline of the cutting element, e.g., from 5° to 80°, from 10° to 70°, from 20° to 60°, or from 30° to 50°. In some aspects, the planar portion 214 may form a 90° angle with the centerline of the cutting element. In some aspects, the planar portion 214 may have an arcuate radial cross-section defined in the cutting face 206.

The planar portions 214 may be positioned proximate to a peripheral edge of the cutting element 200. In some aspects, the plurality of planar portions 214 may be proximate to the chamfer surface 212, and may extend generally radially from proximate the peripheral edge to a central recess region 216 of the cutting element 200 proximate a longitudinal central axis of the cutting element 200. Each planar portion 214 may be defined by an arcuate cross-section having a primary surface with a cross-sectional dimension defined by a radius R1.

FIGS. 2A and 2B each show at least one radially extending spoke 220 disposed on the cutting face 206 of the superabrasive table 204. In some embodiments, the planar portion 214 may be segmented by the spokes 220 into a plurality of planar portions 214. The spokes 220 may extend radially from a periphery of the central recess 216 to the outer circumferential edge 218. The spoke 220 may be formed of integral regions of the superabrasive table 204 and may comprise the same superabrasive material as the superabrasive table 204.

The radially extending spokes 220 may segment the planar portion 214 into generally annular planar portions 214 having an arcuate radial cross-section defined in the cutting face 206 of the cutting element 200. For example, the cutting face 206 of the cutting element 200 may include at least four radially extending spokes 220 equidistantly spaced on the cutting face 206. In this embodiment, the planar portion 214 is divided into four separate planar portions 214. In particular, FIGS. 2A and 2B show that each pair of adjacent spokes 220 are separated by a respective planar portion 214.

Each spoke 220 may traverse at least a portion of the planar portion 214. That is, each spoke 220 may extend at least partially between the outer periphery of the recess 216 (i.e., a region at or proximate the central axis) to an outer circumferential edge 218 of the cutting face 206. For example, each spoke 220 may traverse the entire planar portion 214 and extend from adjacent the central recess 216 to the outer circumferential edge 218 of the cutting face 206. In some embodiments, each spoke 220 may traverse only a portion of the planar portion 214, and therefore, may not reach the periphery and/or the central recess of the cutting face 206.

In some embodiments, each radially extending spoke 220 may comprise an upper surface 222 that may be raised in relation to the substantially planar surfaces 214 of the cutting face 206. As shown in FIG. 2A, the upper surface 222 of the spokes 220 may, in some embodiments, be generally planar. In some embodiments, the upper surface 222 of the spoke 220 may be parallel or transverse to the substantially planar portions 214.

As shown in FIG. 2B, each spoke 220 comprises an interior region 226 and an outer region 228. The interior region 226 is adjacent the periphery of the recess 216 and the outer region 228 is adjacent the outer circumferential edge of the cutting face 206. In some aspects, the spoke 220 increases in height from the interior region 226 to the outer region 228. In some aspects, each spoke 220 may have a maximum height at the outer region 228. In some aspects, each spoke 220 may have an upper surface 222 that is substantially planar and having a uniform height. As shown in FIG. 2B, the upper surface 222 of the spoke 220 may have a greater width (laterally relative to the spoke) at the interior region 226 than the outer region 228 of the upper surface 222. That is, the width of the upper surface 222 decreases from the interior region 226 adjacent the periphery of the central recess 216 to the outer region 228 adjacent the circumferential edge 218 of the cutting face 206. In some aspects, the width of the upper surface 222 may be uniform and substantially constant from the interior region 226 to the outer region 228.

In some aspects, each spoke 220 comprises side surfaces 224 on opposing sides of the upper lateral spoke surface 222. The side surfaces 224 of the radially extending spokes 220 may be sloped or angled relative to the substantially planar surfaces 214 of the cutting face 206. The side surfaces 224 of each spoke 220 may incline toward the substantially planar surfaces 214 of the cutting face 206. In other words, the side surfaces 224 of the radially extending spoke 220 may extend from the substantially planar surface 214 upward, away from the substantially planar surface 214, to the upper surface 222 of the spoke 220. As shown in FIG. 2B, the side surfaces 224 of the spoke 220 may have a greater width at the outer region 228 than the interior region 226. That is, the width of the side surfaces 224 increases from the interior region 226 adjacent the periphery of the central recess 216 to the outer region 228 adjacent the edge of the cutting face 206. In some aspects, the width of the upper surface 222 may be uniform and substantially constant from the interior region 226 to the outer region 228.

As shown in FIG. 2C, the recess 216 has a depth lower than the maximum height the planar portion 214. In some aspects, the recess 216 may be located at the longitudinal centerline of the cutting element, e.g., the recess overlaps with the longitudinal centerline of the cutting element. The recess 216 may be circular, oval, cylindrical, polygonal, or irregularly shaped. In some aspects, the recess 216 is substantially circular. In this aspect, the diameter of the recess may vary widely, and may range, for example, from 5-80% of the total cutter diameter, e.g., from 10-75%, from 20 to 70%, from 30 to 65%, from 40 to 60% or from 50 to 60% of the total cutter diameter.

It is contemplated that the values of the dimensions of the identified features of the cutting element may, in some embodiments, be larger or smaller than these example values, depending on an intended application of the cutting element. In some embodiments, the planar portion 214 has a transverse cross-sectional shape may be defined by further shapes, e.g., a circular arc. For example, a cross-section of the planar portion 214 may be generally defined as one or more of an elliptical arc, a symmetric curved shape, an asymmetric curved shape, a symmetric V-shape, or an asymmetric V-shape.

The diameter of the planar portion 214 may vary widely, and may range, for example, from 5 to 80% of the total cutter diameter, e.g., from 5 to 60%, from 5 to 50%, from 5 to 40%, from 5 to 25% or from 5 to 10% the total cutter diameter. In some aspects, the ratio of the diameter of the recess to the diameter of the planar portion ranges from 0.5:1 to 5:1, e.g., from 0.5:1 to 4:1, from 0.5:1 to 3:1, from 0.5:1 to 2:1, or from 0.5:1 to 1:1.

The height of the cutting element (e.g., the substrate and the superabrasive table) may range 1 cm to 10 cm, e.g., from 1.2 cm to 8 cm, from 1.4 cm to 6 cm, from 1.8 cm to 4 cm, or from 2 cm to 3 cm. In some aspects, the height of cutting elements may be a function of the diameter of the cutting element or the diameter of the recess. In some embodiments, the diameter of the cutting element ranges from 0.1 cm to 0.5 cm, e.g., from 0.15 cm to 0.4 cm, from 0.2 cm to 0.355 cm, from 0.203 cm to 0.355 cm, or from 0.225 cm to 0.345 cm.

In some embodiments, the height of the cutting element may be quantified as 0.35*cutting element diameter, or up to 0.5*cutting element diameter. In some aspects, the height of the cutting element may be quantified as 1.5*recess diameter, or up to 2*recess diameter. The ratio of the height of the cutting element to the diameter of the cutting element and/or the recess may range from about 0.1:1 to 6:1, e.g., from about 0.5:1 to 3:1 or from 1:1 to 2:1. In some embodiments, the ratio of the diameter of the central recess to the diameter of the cutting element may range from about 0.1:1 to 1:1, e.g., from about 0.2:1 to 0.8:1 or from 0.4:1 to 0.6:1.

The contemplated cutting element design may include any number of parameters that can be used to characterize a bit design which include the cutter locations and orientations (e.g., radial and angular positions, heights, profile angles, back rake angles, side rake angles, etc.) and the cutter sizes (e.g., diameter), shapes (i.e., geometry) and bevel size. Additional bit design parameters may include the bit profile, bit diameter, number of blades on bit, blade geometries, blade locations, junk slot areas, bit axial offset (from the axis of rotation), cutter material make-up (e.g., tungsten carbide substrate with hardfacing overlay of selected thickness), etc.

In some embodiments, the recess 216 includes a laterally extending convex surface 219. The convex surface 219 may have a maximum height that is equivalent to a height of the planar portion 214 at a region 215 adjacent to the periphery of the recess 216. In some aspects, the convex surface 219 may have a maximum height that is greater than or less than the height of the planar portion 214 at a region 215 adjacent to the periphery of the recess 216.

Figure 3:
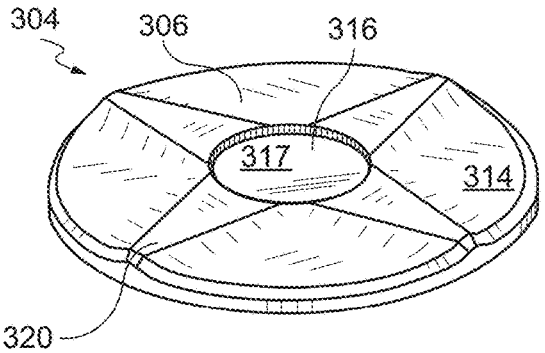
FIG. 3 shows a perspective view of the superabrasive table of a cutting element having a central recess according to some embodiments of the present disclosure.

In some embodiments, the cutting element may not include a convex in the recess. For example, FIG. 3 shows a perspective view of the superabrasive table 304 of a cutting element having a central recess 316 with a planar surface. The superabrasive table 302 may comprise a recess 316 having a planar interior surface 317. The depth of the recess 316 may be greater than the maximum height of the planar surface 314. The planar interior surface 317 may be positioned longitudinally below both the radially extending spoke 320 and a portion of the planar portion 314. In other words, the planar interior surface 317 of the central recess 316 may be positioned within the volume of the superabrasive table 304.

Figure 4:
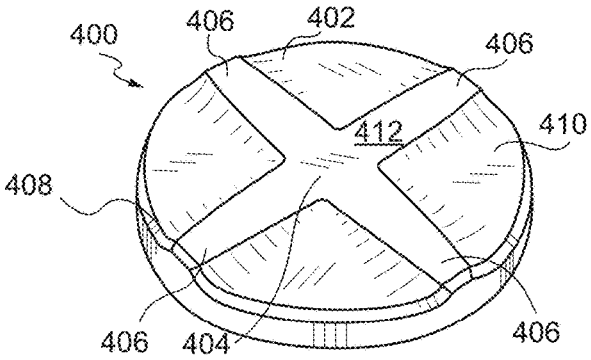
FIG. 4 shows a perspective view of the superabrasive table of the cutting element having a planar cutting surface according to embodiments of the present disclosure.

Although the embodiment of FIG. 3 is shown with a central recess, other embodiments are contemplated that may not include a central recess. For example, FIG. 4 shows a superabrasive table 400 having a cutting face 402 with a shaped cutter surface according to another embodiment of the present disclosure. In the embodiment shown in FIG. 4, the superabrasive table 400 includes a cutting face 402 having a substantially planar central region 404. A plurality of spokes 406 extend radially outward from the central region 404 to the outer circumferential cutting edge 408 of the cutting face 402. A plurality of depressions 410 extend between adjacent spokes from a periphery of the central region 404 to the outer circumferential cutting edge 408 of the cutting face 402. In this embodiment, the cutting face 402 includes a plurality of spokes 406 having an upper surface 412 that is substantially coplanar and continuous with the central region 404 of the cutting face 402.

As shown in FIG. 4, the cutting face 402 includes four equidistantly spaced radially extending spokes 406 that extend radially outward from the central region 404 to form a substantially cross-shaped member. Each spoke 406 has an upper surface 412 that is substantially coplanar with the central region 404. Each spoke 406 may also be continuous with the central region 404. As used herein, "continuous" refers to a surface that has no breaks or gaps. In the embodiment shown in FIG. 4, the entirety of the cross-shaped member may be substantially continuous and planar. That is, each of the radially extending spokes 406 and the central region 404 may be formed on a single plane on the cutting face 402. In this embodiment, the width of each of the radially extending spokes 406 is substantially constant from the central region 404 to the outer circumferential cutting edge 408. In some aspects, one or more of the radially extending spokes 406 may have the greatest width adjacent the central region 404 and the smallest width adjacent the outer circumferential cutting edge 408.

Each radially extending spoke 406 may include an interior region adjacent the central region 404, an outer region adjacent the edge 408 of the cutting face 402, and an upper surface extending therebetween. In some embodiments, the width of the spoke 406 at the interior region may be larger than the width of the spoke 406 at the outer region. In some cases, the ratio of the width of the spoke at the interior region to the width of the spoke at the outer region ranges from 0.5:1 to 10:1, e.g., from 0.6:1 to 8:1, from 0.8:1 to 7:1, from 0.9:1 to 6:1, from 1:1 to 5:1, or from 2:1 to 4:1. In some cases, each of the radially extending spokes comprises an upper surface having a substantial constant width. In embodiments where the ratio of the width of the spoke at the interior region to the width of the spoke at the outer region is approximately 1:1, the spoke may have a substantially rectangular shape.

Figure 5A:
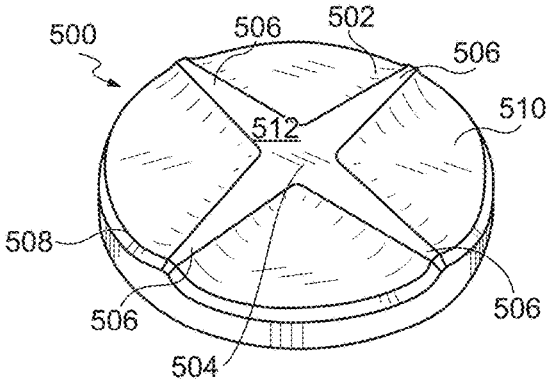
FIG. 5A shows a perspective view of the superabrasive table of the cutting element having a planar cutting surface according to embodiments of the present disclosure.

FIG. 5A shows a superabrasive table 500 having a cutting face 502 with a shaped cutter surface according to another embodiment of the present disclosure. In the embodiment shown in FIG. 5A, the superabrasive table 500 includes a cutting face 502 having a substantially planar central region 504. A plurality of spokes 506 extend radially outward from the central region 504 to the outer circumferential cutting edge 508 of the cutting face 502. A plurality of depressions 510 extend between adjacent spokes 506 from a periphery of the central region 504 to the outer circumferential cutting edge 508 of the cutting face 502. In this embodiment, the cutting face 502 includes a plurality of radially extending spokes 506 having an upper surface that is substantially coplanar and continuous with the central region 504 of the cutting face 502.

The superabrasive table 500 may further include a plurality of depressions 510 segmented by the radially extending spokes 506. Each depression 510 may extend between adjacent spokes 506 from a periphery of the central region 504 to the outer circumferential cutting edge 508 of the cutting face 502. Each of the depressions 510 may be sloped or angled relative to the central region 504, the spokes 506, or both. For example, FIG. 5A shows the depressions 510 sloping downward (in the proximal direction relative to the substrate (not shown)), relative to the longitudinal axis of the table 500, from a region adjacent the central region 504 of the cutting face 502 toward the outer periphery 508 of the cutting face 502. In this embodiment, the depth of the depression 510 relative to the central region 504 increases from an interior radial region to an outer radial region. In some aspects, the depression 510 may merge with the central region 504 and/or the radially extending spokes 506 at an interior region adjacent the central region 504.

Figure 5B:
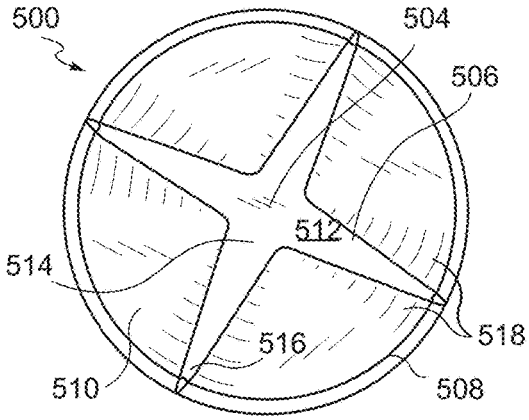
FIG. 5B shows a top plan view of the cutting element of FIG. 5A according to embodiments of the present disclosure.

FIG. 5B shows a top plan view of the superabrasive table of FIG. 5A. Each spoke 506 may comprise an interior region 514 adjacent the central region 504, an outer region 516 adjacent the circumferential edge 508 of the cutting face 502, and an upper surface 512 extending therebetween. In some aspects, the upper surface 512 of each spoke 506 may have a width that is substantially constant from the interior region 514 to the outer region 516. In other aspects, as shown, the upper surface 512 of each spoke 506 may have a width that decreases from the interior region 514 to the outer region 516. The upper surfaces 512 of each of radially extending spokes 506 may be continuous with a central region 504 of the cutting element 500, as shown in FIGS. 5A and 5B. The upper surface 512 of each radially extending spoke 506 may extend from an outer periphery of the cutting face 502 toward a substantially planar central region 504 of the cutting face 502 in a direction toward the central axis. In some aspects, the radially extending spoke 506 may have a substantially hourglass shape. That is, the upper surface 512 of each spoke 506 has a minimum upper surface width in an intermediate region between the central region 504 and the outer region 516.

In some aspects, each spoke 506 may increase in height from the interior region 514 to the outer region 516. That is, the spoke 506 may have a maximum height at the outer region 516 adjacent the outer circumferential edge 508 of the cutting face 502. Conversely, each spoke 506 may decrease in height from the interior region 514 to the outer region 516. That is, the spoke 506 may have a maximum height at the interior region 514 adjacent the central region 504 of the cutting face 502. In some embodiments, the upper surface 512 of the spoke 506 may extend from a substantially planar surface near an outer periphery 508 of the superabrasive table 500 radially inward, toward the central axis, away from the substantially planar surface 510.

Each of the spokes 506 may include sidewalls 518 on opposing sides of the upper surface 512. The sidewalls 518 may extend from the upper surface 512 to the depression 510. In some aspects, each sidewall 518 may extend from the upper surface 512 to the depression 510 at a transverse angle to the upper surface 512 of the spoke 506. In the embodiments shown in FIGS. 5A and 5B, the sidewalls 518 on opposing sides of the upper surface 512 increase in height from the interior region 514 to the outer region 516. In some embodiments, each sidewall decreases in height from the interior region to the outer region.

Figure 6:
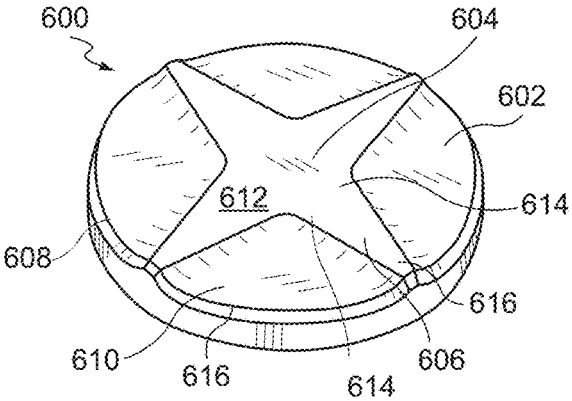
FIG. 6 shows a perspective view of a superabrasive table of a cutting element having a planar cutting surface according to embodiments of the present disclosure.

FIG. 6 illustrates a shaped cutting surface of cutting elements according to some embodiments of the present disclosure. In the embodiment shown in FIG. 6, the superabrasive table 600 comprises a cutting element having a shaped cutting face 602. As previously discussed with respect to FIG. 5A, the cutting face 602 may include a central region 604 and a plurality of spokes 606 radially extending from the central region 604 to the outer periphery 608 of the cutting face 602. In this embodiment, the plurality of radially extending spokes 606 having an upper surface 612 that is substantially coplanar and continuous with the central region 604 of the cutting face 602. For purposes of discussion for FIG. 6, the central region 604 and plurality of spokes 606 will be collectively referred to as the "cutting surface."

The cutting surface on the cutting face 602 may generally have a polygonal shape, e.g., cross-shaped polygon, star-shaped polygon, triangular, etc. For example, the cutting surface may include four equidistantly spaced radially extending spokes 606 that extend radially from a central region 604 outwardly to the outer circumference 608 of the cutting face 602. In embodiment shown in FIG. 6, the entirety of the cutting surface has an upper surface 612 that is substantially co-planar and continuous. It is contemplated, however, the cutting surface may include an upper surface 612 that is not coplanar as discussed above. For example, the radially extending spokes 606 may slope downwardly from the central region 604 of the cutting surface outwardly toward the outer circumference 608 of the cutting face 602, or vice versa. Additionally, the radially extending spokes 606 and/or central region 604 may include grooves or protrusions.

Each spoke 606 of the cutting surface includes an interior region 614 adjacent the central region 604 and an outer region 616 adjacent the edge of the cutting face 602. The upper surface 612 extends between the interior region 614 and the outer region 616. In the embodiment shown in FIG. 6, the upper surface 612 of each spoke 606 has a width that decreases from the interior region 614 to the outer region 616. In this respect, the each spoke 606 is substantially triangular with various geometric attributes, e.g., width of the spoke, height of the spoke, angles formed by the spoke at the apex, etc.

Figure 7:
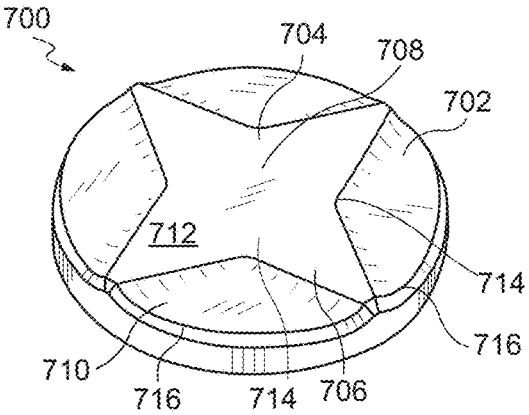
FIG. 7 shows a perspective view of a superabrasive table of a cutting element having a planar cutting surface according to embodiments of the present disclosure.

FIG. 7 shows another embodiment of the shaped cutting surface having a cutting surface 704 including a plurality of spokes 706. In some aspects, the width of the spoke 706 at the interior region 714 may be less than the radius (R1) of the cutting face 702, e.g., less than R1, less than 0.9 R1, less than 0.75 R1, less than 0.5 R1, or less than 0.33 R1. In some aspects, the width of the spoke 706 at the outer region 716 may be less than the radius of the cutting face 702, e.g., less than 0.75 R1, less than 0.5 R1, less than 0.33 R1, or less than 0.25 R1. In some aspects, the width of the spoke 706 at the interior region 714 may be substantially equivalent to the width of the spoke 706 at the outer region 716. In the embodiment shown in FIG. 7, the width of the spoke 706 at the interior region 714 is substantially larger than that shown in FIG. 6. In this respect, the cutting surface 704 of FIG. 7 has a much larger surface area, e.g., contact surface, than the cutting surface of FIG. 6. In some embodiments, the plurality of spokes comprises greater than 25% of the total surface area of the cutting face, e.g., greater than 30%, greater than 40%, greater than 50%, or greater than 60%. In some cases, the cutting surface (e.g., the plurality of spokes taken together with the central region), comprises greater than 40% of the total surface area of the cutting face, e.g., greater than 50%, greater than 60%, greater than 70%, or greater than 80%.

The superabrasive table 700 may further include one or more regions 710 separated by the cutting surface 704. Each region 710 may extend between adjacent spokes 706 from a periphery of the central region 708 of the cutting surface 704 to the outer circumferential edge of the cutting face 702. Each of the regions 710 may be sloped or angled relative to the cutting surface 704 of the cutting face 702. As shown in FIG. 7, each of the regions 710 slope downwardly from an interior radial region 714 adjacent the central region 708 of the cutting surface 704 towards an outer radial region 716 of the cutting face 702. In these embodiments, the depth of each of the regions 710 increases from an interior radial region 714 to an outer radial region 716. In some aspects, a portion of the region 710 adjacent the central region 708, e.g., proximate to the interior radial region 714, merges with a portion of the cutting surface 704. For example, portion of the region 710 adjacent the central region 708 may merge with a portion of the spoke 706 and/or the central region 708 of the cutting surface 704.

Figure 8:
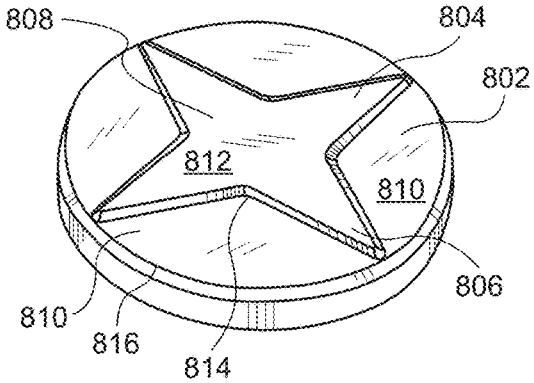
FIG. 8 shows a perspective view of a superabrasive table of a cutting element having a planar cutting surface according to embodiments of the present disclosure.

As shown in FIG. 8, the upper surface 812 of the radially extending spoke 806 may not extend completely across the cutting face 802 to the circumferential edge of the cutting face 802. That is, the radially extending spoke 806 may positioned radially inward from a substantially planar portion of the cutting face 802 adjacent a cutting edge of the cutting face 802. For example, FIG. 8 shows a radially extending spoke 806 extending from an interior region 814 adjacent the central region 808 to an exterior region 816 adjacent the cutting edge of the cutting face 802. The substantially planar portion may separate the termination point of the spoke 806 and the circumferential edge of the cutting face 802, e.g., interface of the cutting face and the chamfer. In this embodiment, the upper surface 812 of the cutting surface 804 is substantially continuous and coplanar.

The cutting surface 804 may include a star-shaped member, optionally having three, four, five, six or more points, disposed on the cutting face 802. In some aspects, the cutting surface 804 may be integrally formed on the cutting face 802 and the entirety of the cutting surface 804 is raised in relation to a substantially planar cutting face 802. In this embodiment, the regions 810 may be planar and flat.

In some aspects, the upper surface 812 of at least one spoke 806 is angled relative to a substantially planar surface of cutting surface 804 of the superabrasive table. Each radially extending spoke 806 may have a substantially uniform circumferential width along a radially extending length. However, in additional embodiments, the circumferential width of a radially extending spoke 806 may vary along a radially extending length.

Figure 9:
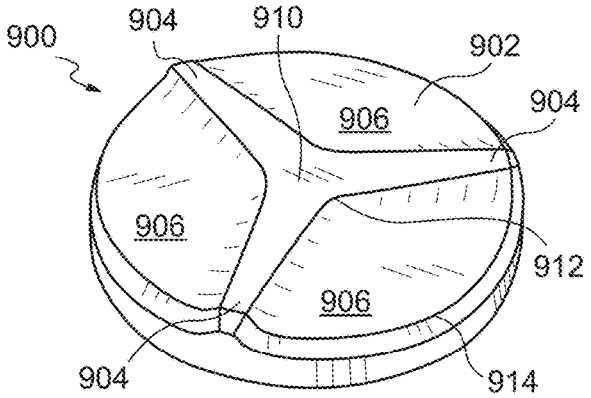
FIG. 9 shows a perspective view of a superabrasive table of a cutting element having three radially extending spokes according to embodiments of the present disclosure.

As shown in FIG. 9, the superabrasive table 900 may comprise a cutting face 902 having three radially extending spokes 904. The three radially extending spokes 904 segment the cutting face 902 into three distinct regions 906 separated by each of the spokes 904. The radially extending spokes 904 may be equidistantly spaced on the cutting face. For example, the radial distance between each of the radially extending spokes 904 may be equivalent from any distance along the diameter of the cutting face 902. In this respect, each segmented region 906 separated by the radially extending spokes 904 may have substantially the same surface area and/or radius. In some embodiments, the radially extending spokes 904 may be unevenly spaced between each of the radially extending spokes 904, e.g., Y-shaped, T-shaped, or variations thereof.

Each of the segmented regions 906 may extend between adjacent spokes 904 from a periphery of the central region 910 of the cutting face 902 to the outer periphery 914 of the cutting face 902. The segmented regions 906 may be sloped or angled relative to the upper surface of the radially extending spokes 904. As shown in FIG. 9, the segmented regions 906 may decline from a region 912 adjacent the central region 910 of the cutting face towards the outer periphery 914 of the cutting face. For example, the segmented regions 906 may have the greatest height at the region 912 adjacent the central region 910. Conversely, the segmented regions 906 may have the greatest height at the region adjacent the outer periphery 914 of the cutting face 902. In some aspects, the depth of the segmented regions 906 may be substantially constant from the region 912 adjacent the central region 910 to the outer periphery 914 of the cutting face 902.

In some embodiments, a cutter element employing the superabrasive table 900 shown in FIG. 9 may be useful as a low profile cutter. That is, the cutter element may be mounted on the rotary drill bit to have a relatively low exposure height, e.g., a low profile cutter. For example, in a fixed cutter drill bit having radially-spaced sets of cutter elements, the cutter element sets preferably overlap in rotated profile and include at least one low profile cutter element. The low profile element is mounted to have a relatively low exposure height. Providing an arrangement of low and, for example, high profile cutter elements, tends to increase the bit's ability to resist vibration and provides an aggressive cutting structure, even after significant wear has occurred.

Figure 10:
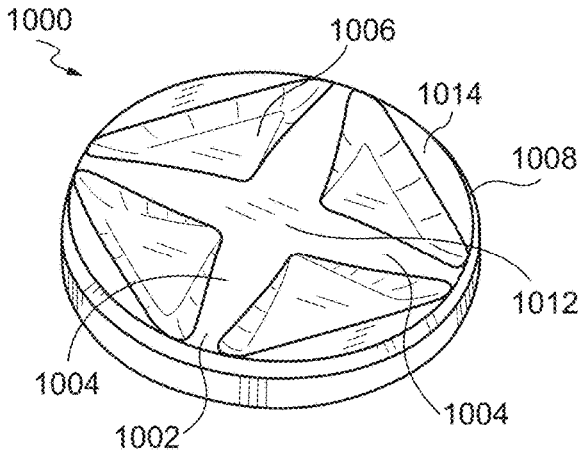
FIG. 10 shows a perspective view of a superabrasive table of a cutting element having depressed regions according to embodiments of the present disclosure.

FIG. 10 shows another embodiment of the shaped cutter element having one or more depressed regions. The superabrasive table 1000 of the cutting element may comprise a cutting face 1002 having one or more radially extending spokes 1004 that segment the cutting face 1002 into one or more regions defined in the cutting face 1002. In the embodiment shown in FIG. 10, a plurality of depressed regions 1006 are positioned proximate to a peripheral edge 1008 of the cutting face 1002, e.g., proximate to the chamfer. For example, a generally triangular depressed region 1006 may be defined in the cutting face 1002 of the superabrasive table 1000, which may be divided into segments by the radially extending spokes 1004. In some embodiments, an interior region of each depression, adjacent the central region, forms an obtuse angle between adjacent spokes. In some embodiments, an interior region of each depression between adjacent spokes forms an angle ranging from 90° to 180°, e.g., from 95° to 170°, from 100° to 160°, or from 120° to 140°.

As shown in FIG. 10, the entirety of the one or more regions 1006 is positioned radially inward from a substantially planar portion 1014 of the cutting face 1002 adjacent a peripheral edge 1008 of the cutting face 1002 with respect to a longitudinal axis of superabrasive table 1000. That is, one or more depressed regions 1006 formed on the cutting face 1002 may extend radially from proximate the substantially planar peripheral edge portion 1014 to a central region 1012 of the cutting face 1002. In this embodiment, at least a portion of the region 1006 does not extend to the peripheral edge 1008 of the cutting face 1002. In other words, a portion of region 1006 is separated by the substantially planar portion 1014 from the peripheral edge 1008 of the cutting face 1002.

Figure 11:
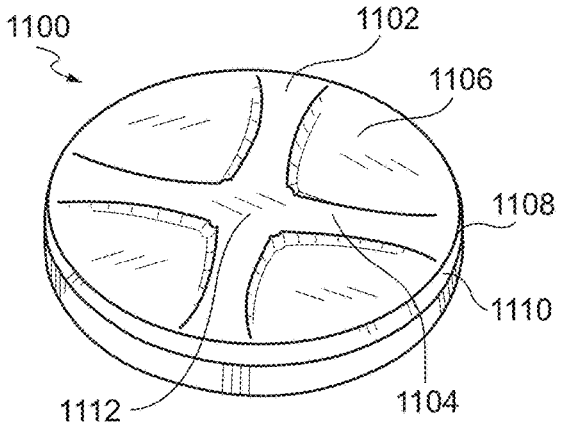
FIG. 11 shows a perspective view of a superabrasive table of a cutting element having depressed regions according to embodiments of the present disclosure.

FIG. 11 shows another embodiment of the shaped cutter element having one or more depressed regions. In this embodiment, one or more depressed regions 1106 extend radially outward from a region adjacent the central region 1112 of the cutting face 1102 proximate a longitudinal central axis to the peripheral edge 1108 of the cutting face 1102. That is, the cutting face shown FIG. 11 does not include a substantially planar portion adjacent the peripheral edge 1108 of the cutting face 1102. The depressed regions 1106 defined in the cutting face 1102 may be positioned proximate to or at the peripheral edge 1108 of the cutting face 1102, such as proximate to the chamfer surface, and may extend generally radially from the peripheral edge 1108 to a region proximate to the central region 1112.

The depressed regions 1106 may extend between adjacent spokes 1104 from a region adjacent the central region 1112 of the cutting face 1102 to the peripheral edge 1108 of the cutting face 1102. The depressed regions 1106 may be sloped or angled relative to the upper surface of the radially extending spokes 1104. For example, the depressed regions 1106 may slope upwardly (or downwardly) away from the longitudinal centerline of the cutting face 1102 from a region adjacent the central region 1112 of the cutting face towards the peripheral edge 1108 of the cutting face 1102. In some embodiments, each depression has a depth that decreases from an interior radial region (e.g., adjacent the central region) to an outer radial region (e.g., adjacent the cutting edge). In some embodiments, each depression has a depth that increases from an interior radial region (e.g., adjacent the central region) to an outer radial region (e.g., adjacent the cutting edge).

In some embodiments, the depressed region 1106 may have the greatest depth at a region adjacent the central region 1112. In some aspects, the depressed region 1106 may merge with the cutting face 1102 at a region adjacent the peripheral edge 1108 of the cutting face 1102 as shown in FIG. 11. In particular, the depressed region 1106 may be coplanar with the cutting face 1102 at a region adjacent the peripheral edge 1108 of the cutting face 1102. In some cases, each of the spokes 1104 may have an hourglass-like shape. That is, each of the spokes 1104 may comprise an upper surface with an intermediate region between the central region 1112 and the peripheral edge 1108 that has a minimum width. In some aspects, each depression merges with a portion of one or more spokes at the interior region adjacent the central region.

Each of the depressed regions 1106 defined in the cutting face 1102 may be defined by an arcuate cross-section having a primary surface with a cross-sectional dimension defined by a radius. For example, each region 1106 may be an arcuate depression defined by a radius R1. Of course, values of the dimensions of the identified features of the cutting element may, in some embodiments, be larger or smaller than these example values, depending on an intended application of the cutting element, for example.

As shown in FIG. 11, each spoke 1104 may traverse at least a portion of the depressed region 1106 and, therefore, may extend at least partially between a central region 1112 of the superabrasive table 1100 (i.e., a region at or proximate the central axis) and a peripheral edge 1108 of the superabrasive table 1100. For example, each spoke 1104 may traverse the entire depression 1106 and extend from the central region 1112 to the peripheral edge 1108 of the table 1100. In some embodiments, as shown in FIG. 11, each radially extending spoke may comprise an upper surface that may be coplanar with the central region 1112 of the cutting face 1102. The side surfaces of the spokes 1104 proximate the region 1106 may, in some embodiments, be generally planar and perpendicular to the upper surfaces of the spokes 1104.

As shown in the embodiments of FIGS. 12-16, the cutting element may have shaped cutters with asymmetric cutting surfaces according to some embodiments of the present disclosure. Each of the embodiments shown in FIGS. 12-16 provide asymmetric configurations of the cutting surface on the cutting face. In other words, the cutting surface has no axis of mirror symmetry and so defines a cutting surface having a cutting profile of an asymmetric shape. The asymmetric cutting shape may increase the depth of rock formation cut by each cutting element. In some embodiments, the superabrasive table may, for example, exhibit a non-planar, asymmetric cutting face that requires a particular orientation relative to a rotational path traveled by the cutting element in order to effectively engage the subterranean formation. In general, each of the cutting elements shown in FIGS. 12-16 includes a cutting face having one or more radially extending spokes that may segment the cutting face into one or more regions defined in the cutting face.

Figure 12:
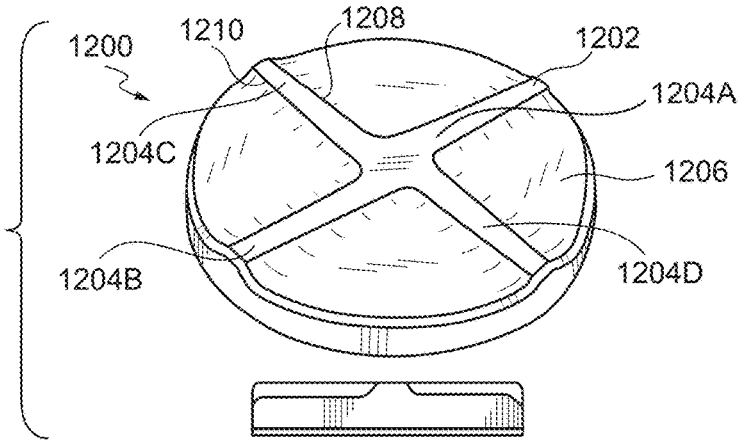
FIG. 12 shows a perspective view of a superabrasive table of a cutting element having an asymmetric planar cutting surface according to embodiments of the present disclosure.

FIG. 12 shows one embodiment of the shaped cutting element 1200 with an asymmetric cutting surface. The cutting face 1202 may comprise a plurality of radially extending spokes 1204A-D. In some aspects, each pair of opposing spokes (1204A,B and 1204C,D) are offset on the cutting face 1202. In particular, at least two opposing spokes 1204A, 1204B are offset with respect to the y-axis of the cutting face 1202 and at least two opposing spokes 1204C, 1204D are offset with respect to the x-axis of the cutting face 1202. In this embodiment, the segmented regions 1206 may have different surface areas. For example, the segmented regions 1206 on opposing sides of the cutting face 1202 may have the same or substantially the same surface area and adjacent segmented regions 1206 may have different surface areas.

Each of the radially extending spokes 1204A-D may have a leading wall 1208 and a trailing wall 1210. As shown in FIG. 12, the leading wall 1208 may have a shorter length than the trailing wall 1210. For example, when taken in the clockwise direction, the leading wall 1208 has a shorter length than the trailing wall 1210. In some cases, the leading wall 1208 may have a longer length than the trailing wall 1210. For example, when taken in the clockwise direction, the leading wall 1208 has a longer length than the trailing wall 1210. Each of the radially extending spokes 1204A-D may be substantially coplanar and continuous with a central region of the cutting face 1202.

Figure 13:
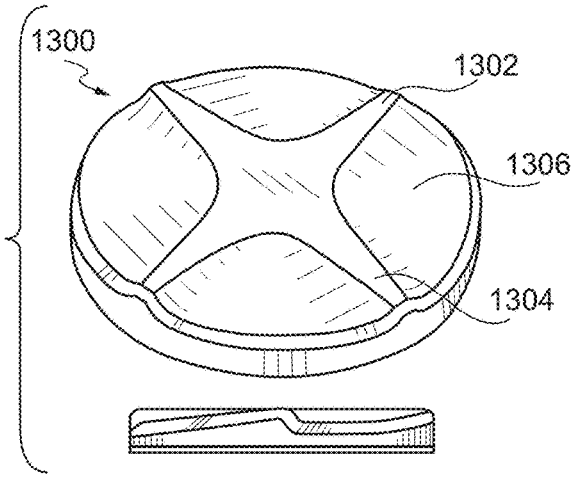
FIG. 13 shows a perspective view of a superabrasive table of a cutting element having an asymmetric planar cutting surface according to embodiments of the present disclosure.

FIG. 13 shows another embodiment of the shaped cutting element 1300 having an asymmetric cutting face 1302. In this embodiment, each pair of adjacent spokes 1304 may form an angle on the cutting face 1302. The spokes 1304 may be angled with respect to an opposing spoke, or each spoke may have different angles on the cutting face with respect to the longitudinal axis of the cutting face 1302. In particular, opposing spokes 1304 may be at different angles with respect to the longitudinal axis of the cutting face 1302 to provide an asymmetric cutting surface. For example, each pair of adjacent spokes 1304 can form an angle on the cutting face that is different from an angle formed by another pair of adjacent spokes 1304. In some embodiments, the angle formed between each pair of adjacent spokes 1304 is the same, e.g., all four angles on the cutting face may be equivalent. In some embodiments, each pair of adjacent spokes 1304 forms an angle on the cutting face that is different and distinct than angle formed by another pair of adjacent spokes 1304. In this embodiment, the segmented regions 1306 may have different surface areas.

Figure 14:
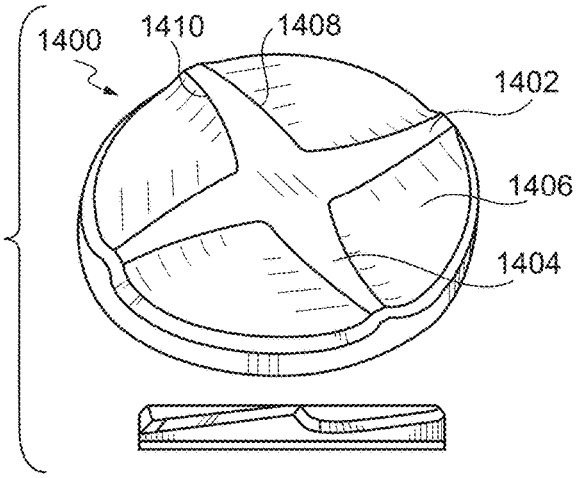
FIG. 14 shows a perspective view of a superabrasive table of a cutting element having an asymmetric planar cutting surface according to embodiments of the present disclosure.
Figure 15:
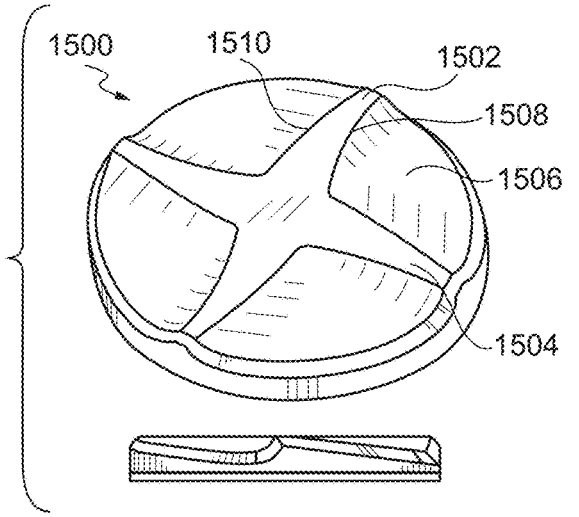
FIG. 15 shows a perspective view of a superabrasive table of a cutting element having an asymmetric planar cutting surface according to embodiments of the present disclosure.

FIGS. 14 and 15 show some embodiments of the shaped cutting element having an asymmetric cutting face. In each of FIGS. 14 and 15, the cutting face comprises at least four spokes extending from a central region of the cutting face, e.g., at or proximate to the longitudinal center of the cutting element, to an outer periphery of the cutting face. Each of the at least four spokes have opposing lateral sides that are not mirror images of each other, e.g., asymmetric. For example, at least one of the lateral sides of the spoke is convex and/or at least one of the lateral sides is concave.

In FIG. 14, each of the spokes 1404 comprise a leading wall 1408 and a trailing wall 1410. In this embodiment, the leading wall 1408 comprise a convex portion and the trailing wall 1410 comprises a concave portion. In the embodiment shown in FIG. 15, the leading wall 1508 comprises a concave portion and the trailing wall 1510 comprise a convex portion. In these embodiments, the intersection point of each pair of adjacent spokes 1502 are generally rounded, e.g., curved.

Figure 16:
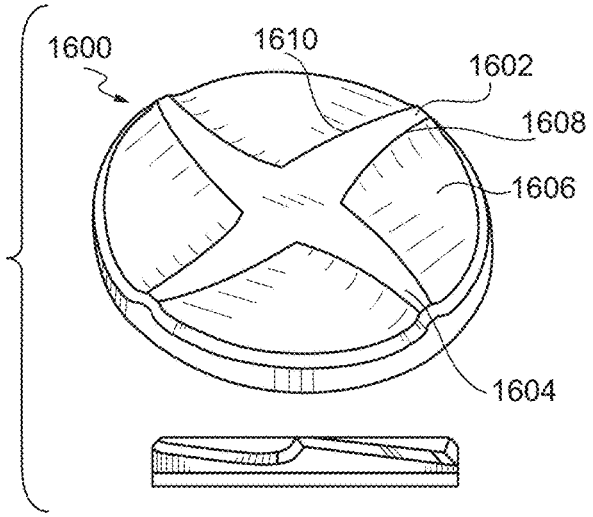
FIG. 16 shows a perspective view of a superabrasive table of a cutting element having an asymmetric planar cutting surface according to embodiments of the present disclosure.

FIG. 16 shows another embodiment of the shaped cutting element having an asymmetric cutting face 1602. The cutting face 1602 may comprise a plurality of spokes 1604 that are separated by depressed regions 1606. Each of the plurality of spokes 1604 may comprise a leading wall 1608 and a trailing wall 1610. In this embodiment, the leading wall 1608 and the trailing wall 1610 may be substantially linear. In some aspects, the trailing wall 1610 is convex and the leading wall 1608 is linear. For example, the cutting face 1602 may comprise a trailing wall 1608 that is a concave or convex, and a leading wall 1610 that is substantially linear, or vice versa. The substantially straight edge may form a sharp intersection between each pair of adjacent spokes 1604.

In the embodiments shown in FIGS. 12-16, the spokes are generally raised in relation to the cutting face of the superabrasive table. The spokes include an upper surface that is substantially coplanar and continuous with the central region. In some embodiments, each of the spokes may include a first side extending from the upper surface of the spoke to the cutting face and an opposing second side extending from the upper surface to the cutting face. As explained above, the first side and the second side of the spoke may be concave, convex, or substantially linear. For example, one or more spokes may include a first side surface that is convex and the second side surface of the spoke may be concave.

The cutting face may exhibit any desired peripheral geometric configuration (e.g., peripheral shape and peripheral size). The peripheral geometric configuration of the cutting face may be selected relative to a desired position of the cutting element on an earth-boring tool to provide the cutting face with desired interaction (e.g., engagement) with a subterranean formation during use and operation of the earth-boring tool. For example, the shape of the cutting face may be selected to facilitate one or more of shearing, crushing, and gouging of the subterranean formation during use and operation of the earth-boring tool.

The cutting face may exhibit a substantially consistent lateral cross-sectional shape but variable lateral cross-sectional dimensions throughout a longitudinal thickness thereof, may exhibit a different substantially consistent lateral cross-sectional shape and substantially consistent lateral cross-sectional dimensions throughout the longitudinal thickness thereof, or may exhibit a variable lateral cross-sectional shape and variable lateral cross-sectional dimensions throughout the longitudinal thickness thereof. By way of non-limiting example, the cutting face may exhibit a chisel shape, a frustoconical shape, a conical shape, a dome shape, an elliptical cylinder shape, a rectangular cylinder shape, a circular cylinder shape, a pyramidal shape, a frusto pyramidal shape, a fin shape, a pillar shape, a stud shape, a truncated version of one of the foregoing shapes, or a combination of two or more of the foregoing shapes.

Accordingly, the cutting face may have any desired lateral cross-sectional shape including, but not limited to, an elliptical shape, a circular shape, a tetragonal shape (e.g., square, rectangular, trapezium, trapezoidal, parallelogram, etc.), a triangular shape, a semicircular shape, an ovular shape, a semicircular shape, a tombstone shape, a tear drop shape, a crescent shape, or a combination of two or more of the foregoing shapes. The peripheral shape of cutting face may be symmetric, or may be asymmetric.

EXAMPLE

Subterranean drilling runs were performed in Dewey County, Okla. using 6.125 inch bits. Most runs were performed using flat table PDC cutters on standard rotary bits, but a select few were performed using the cutters of FIGS. 5A and 5B. The cutters were run on rotary drill bits having 6 or 7 blades. The rotary drill bits were tested on granite formations between 20,000 and 25,000 psi.

Figure 17:
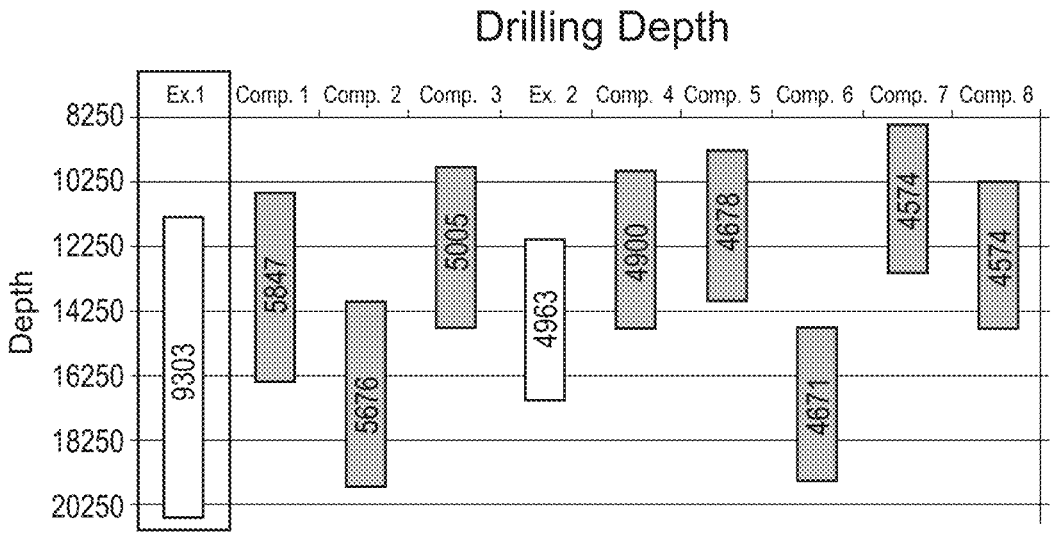
FIG. 17 shows performance characteristics of shaped cutter elements according to the present disclosure.

The top ten longest runs were selected and compared to one another. The results are provided in FIG. 17. As shown, two of the top five runs, including the longest run, employed the shaped cutters described herein. In fact, the best run was 9303 feet, which bested the second best run of 5847 feet by 3456 feet, which is an increase of 59% in footage drilled.

Embodiments

Embodiment 1: A cutting element, comprising: a substantially cylindrical substrate; a superabrasive table positioned on the cylindrical substrate, the superabrasive table comprising: a cutting face having a substantially planar portion surrounding a central recess, the planar portion extending laterally to an outer circumferential edge; and at least one spoke disposed on the cutting face, the spoke extending radially from a periphery of the recess to the outer circumferential edge.

Embodiment 2: An embodiment of embodiment 1, wherein each spoke comprises an upper surface having an interior region adjacent the periphery of the recess and an outer region adjacent the edge of the cutting face, wherein the upper surface has an upper surface width that decreases from the interior region to the outer region.

Embodiment 3: An embodiment of embodiment 1, wherein the spoke is raised in relation to the planar portion of the cutting face.

Embodiment 4: An embodiment of embodiment 1, wherein the spoke comprises an interior region adjacent the periphery of the recess and an outer region adjacent the edge of the cutting face, wherein the spoke has a height that increases from the interior region to the outer region, and wherein the spoke has a maximum height at the outer region.

Embodiment 5: An embodiment of embodiment 1, wherein the spoke comprises an interior region adjacent the periphery of the recess, an outer region adjacent the edge of the cutting face, and an upper lateral spoke surface extending therebetween, wherein the spoke comprises sidewalls on opposing sides of the upper lateral spoke surface, each of the sidewalls extending from the upper lateral spoke surface to the planar portion of the cutting face.

Embodiment 6: An embodiment of embodiment 1, wherein each of the sidewalls are transverse relative to the upper lateral spoke surface of the spoke and the planar portion of the cutting face, wherein each sidewall increases in height from the interior region to the outer region.

Embodiment 7: An embodiment of embodiment 1, comprising at least four spokes equidistantly spaced on the cutting face, wherein the planar portion is divided into four separate planar portions, each pair of adjacent spokes being separated by a respective planar portion.

Embodiment 8: An embodiment of embodiment 1, wherein the recess is substantially circular and is defined by a laterally extending convex surface and a longitudinally extending circumferential side wall.

Embodiment 9: An embodiment of embodiment 1, wherein the superabrasive table comprises a chamfered region between the edge of the cutting face and a sidewall of the cylindrical substrate.

Embodiment 10: A cutting element for drilling subterranean formations, comprising: a substantially cylindrical substrate; a superabrasive table positioned on the cylindrical substrate, the superabrasive table comprising: a cutting face having a substantially planar central region and an outer circumferential cutting edge; a plurality of spokes extending radially outward from the central region to the edge of the cutting face, wherein each spoke comprises an interior region adjacent the central region, an outer region adjacent the edge of the cutting face, and an upper surface extending therebetween, wherein a ratio of an upper surface width at the interior region to the upper surface width at the outer region ranges from 0.5:1 to 2:1; and a plurality of depressions, each depression extending between adjacent spokes and from a periphery of the central region to the outer circumferential cutting edge of the cutting face.

Embodiment 11: An embodiment of embodiment 10, wherein the upper surface of each spoke is substantially co-planar and continuous with the central region.

Embodiment 12: An embodiment of embodiment 10, wherein the upper surface of each spoke has a width that is substantially constant from the interior region to the outer region.

Embodiment 13: An embodiment of embodiment 10, wherein the upper surface of each spoke has a width that decreases from the interior region to the outer region.

Embodiment 14: An embodiment of embodiment 10, wherein each depression has a depth that increases from an interior radial region to an outer radial region, wherein each depression merges with the cutting edge.

Embodiment 15: An embodiment of embodiment 10, wherein each depression merges with a portion of one or more spokes at the interior region adjacent the central region.

Embodiment 16: An embodiment of embodiment 10, wherein the cutting face does not include a substantially planar outer lateral circumferential portion adjacent the cutting edge of the cutting face.

Embodiment 17: An embodiment of embodiment 10, wherein each spoke increases in height from the interior region to the outer region, and wherein the spoke has a maximum height at the outer region.

Embodiment 18: An embodiment of embodiment 10, wherein each spoke includes sidewalls on opposing sides of the upper surface, each of the sidewalls extending from the upper surface to the depression.

Embodiment 19: An embodiment of embodiment 18, wherein each sidewall extends from the upper surface to the depression of an associated spoke at a transverse angle.

Embodiment 20: An embodiment of embodiment 10, comprising at least four spokes equidistantly spaced on the cutting face, wherein each of the at least four spokes are symmetrically arranged on the cutting face, wherein each of the at least four spokes are continuous and co-planar with the central region.

Embodiment 21: An embodiment of embodiment 10, wherein the upper surface has a minimum upper surface width in an intermediate region between the central region and the outer region.

Embodiment 22: An embodiment of embodiment 10, wherein an interior region of each depression forms an angle ranging from 45° to 180° between adjacent spokes.

Embodiment 23: An embodiment of embodiment 10, wherein each depression has a depth that is constant or decreases from an interior radial region to an outer radial region.

Embodiment 24: An embodiment of embodiment 23, wherein the cutting face includes a substantially planar outer lateral circumferential portion adjacent the cutting edge of the cutting face.

Embodiment 25: An embodiment of embodiment 23, wherein each spoke comprises an interior region adjacent the central region, an outer region adjacent the edge of the cutting face, and an upper surface extending therebetween, wherein the upper surface has a minimum upper surface width in an intermediate region between the central region and the outer region.

Embodiment 26: A cutting element for drilling subterranean formations, comprising: a substantially cylindrical substrate; a superabrasive table positioned on the cylindrical substrate, the superabrasive table comprising: an asymmetric cutting face having a substantially planar central region and an outer circumferential cutting edge; a plurality of spokes extending radially outward from the central region to the edge of the cutting face, each spoke comprises an interior region adjacent the central region, an outer region adjacent the cutting edge of the cutting face, and an upper surface extending therebetween, wherein each spoke includes sidewalls on opposing sides of the upper surface; and a plurality of depressions, each depression extending between adjacent spokes and from a periphery of the central region to the outer circumferential cutting edge of the cutting face.

Embodiment 27: An embodiment of embodiment 26, wherein each spoke has a leading sidewall and a trailing sidewall and, when taken in the clockwise direction, the leading sidewall has a shorter length than the trailing sidewall.

Embodiment 28: An embodiment of embodiment 26, wherein each spoke has a leading sidewall and a trailing sidewall and, when taken in the clockwise direction, the leading sidewall has a longer length than the trailing sidewall.

Embodiment 29: An embodiment of embodiment 26, wherein the sidewalls of each of the spokes are not mirror images of each other.

Embodiment 30: An embodiment of embodiment 26, wherein at least one of the sidewalls is convex.

Embodiment 31: An embodiment of embodiment 26, wherein at least one of the sidewalls is concave.

Embodiment 32: An embodiment of embodiment 26, wherein the upper surface of each spoke is substantially co-planar continuous with the central region.

Embodiment 33: An embodiment of embodiment 26, comprising at least four spokes spaced apart on the cutting face, wherein each of the at least four spokes are continuous and co-planar with the central region.

It should be understood that various different features described herein may be used interchangeably with various embodiments. For example, if one feature is described with respect to particular example, it is understood that that same feature may be used with other examples as well.

Although certain embodiments have been shown and described, it should be understood that changes and modifications, additions and deletions may be made to the structures and methods recited above and shown in the drawings without departing from the scope or spirit of the disclosure or the following claims.

What is claimed is:

1. A cutting element, comprising:

a substantially cylindrical substrate;

a superabrasive table positioned on the cylindrical substrate, the superabrasive table comprising:

a cutting face having a substantially planar portion surrounding a central recess, the planar portion extending laterally to an outer circumferential edge; and at least one spoke disposed on the cutting face, each spoke extending radially from a periphery of the recess to the outer circumferential edge;

wherein the central recess comprises a convex member.

2. The cutting element of claim 1, wherein each spoke comprises an upper surface having an interior region adjacent the periphery of the recess and an outer region adjacent the edge of the cutting face, wherein the upper surface has an upper surface width that decreases from the interior region to the outer region.

3. The cutting element of claim 1, wherein each spoke is raised in relation to the planar portion of the cutting face.

4. The cutting element of claim 1, wherein each spoke comprises an interior region adjacent the periphery of the recess and an outer region adjacent the edge of the cutting face, wherein each spoke has a height that increases from the interior region to the outer region, and wherein each spoke has a maximum height at the outer region.

5. The cutting element of claim 1, wherein each spoke comprises an interior region adjacent the periphery of the recess, an outer region adjacent the edge of the cutting face, and an upper lateral spoke surface extending therebetween, wherein each spoke comprises sidewalls on opposing sides of the upper lateral spoke surface, each of the sidewalls extending from the upper lateral spoke surface to the planar portion of the cutting face.

6. The cutting element of claim 5, wherein each of the sidewalls are transverse relative to the upper lateral spoke surface of each spoke and the planar portion of the cutting face, wherein each sidewall increases in height from the interior region to the outer region.

7. The cutting element of claim 1, comprising at least four spokes equidistantly spaced on the cutting face, wherein the planar portion is divided into four separate planar portions, each pair of adjacent spokes being separated by a respective planar portion.

8. The cutting element of claim 1, wherein the superabrasive table comprises a chamfered region between the edge of the cutting face and a sidewall of the cylindrical substrate.

9. A cutting element for drilling subterranean formations, comprising:

a substantially cylindrical substrate;

a superabrasive table positioned on the cylindrical substrate, the superabrasive table comprising:

a cutting face having a substantially planar central region and an outer circumferential cutting edge;

a plurality of spokes extending radially outward from the central region to the edge of the cutting face, wherein each spoke comprises an interior region adjacent the central region, an outer region adjacent the edge of the cutting face, and an upper surface extending therebetween, wherein a ratio of an upper surface width at the interior region to the upper surface width at the outer region ranges from 0.5:1 to 2:1, wherein the upper surface of each of the spokes is flat and co-planar with the central region; and a plurality of depressions, each depression extending between adjacent spokes and from a periphery of the central region to the outer circumferential cutting edge of the cutting face.

10. The cutting element of claim 9, wherein the upper surface of each spoke is substantially co-planar and continuous with the central region.

11. The cutting element of claim 9, wherein the upper surface of each spoke has a width that is substantially constant from the interior region to the outer region.

12. The cutting element of claim 9, wherein the upper surface of each spoke has a width that decreases from the interior region to the outer region.

13. The cutting element of claim 9, wherein each depression has a depth that increases from an interior radial region to an outer radial region, wherein each depression merges with the cutting edge.

14. The cutting element of claim 9, wherein each depression merges with a portion of one or more spokes at the interior region adjacent the central region.

15. The cutting element of claim 9, wherein the cutting face does not include a substantially planar outer lateral circumferential portion adjacent the cutting edge of the cutting face.

16. The cutting element of claim 9, wherein each spoke increases in height from the interior region to the outer region, and wherein the spoke has a maximum height at the outer region.

17. The cutting element of claim 9, wherein each spoke includes sidewalls on opposing sides of the upper surface, each of the sidewalls extending from the upper surface to the depression.

18. The cutting element of claim 17, wherein each sidewall extends from the upper surface to the depression of an associated spoke at a transverse angle.

19. The cutting element of claim 9, comprising at least four spokes equidistantly spaced on the cutting face, wherein each of the at least four spokes are symmetrically arranged on the cutting face, wherein each of the at least four spokes are continuous and co-planar with the central region.

20. The cutting element of claim 9, wherein the upper surface has a minimum upper surface width in an intermediate region between the central region and the outer region.

21. The cutting element of claim 9, wherein an interior region of each depression forms an angle ranging from 45° to 180° between adjacent spokes.

22. The cutting element of claim 9, wherein each depression has a depth that is constant or decreases from an interior radial region to an outer radial region.

23. The cutting element of claim 22, wherein the cutting face includes a substantially planar outer lateral circumferential portion adjacent the cutting edge of the cutting face.

24. The cutting element of claim 22, wherein each spoke comprises an interior region adjacent the central region, an outer region adjacent the edge of the cutting face, and an upper surface extending therebetween, wherein the upper surface has a minimum upper surface width in an intermediate region between the central region and the outer region.

25. A cutting element for drilling subterranean formations, comprising:

a substantially cylindrical substrate;

a superabrasive table positioned on the cylindrical substrate, the superabrasive table comprising:

an asymmetric cutting face having a substantially planar central region and an outer circumferential cutting edge;

a plurality of spokes extending radially outward from the central region to the edge of the cutting face, each spoke comprises an interior region adjacent the central region, an outer region adjacent the cutting edge of the cutting face, and an upper surface extending therebetween, wherein each spoke includes sidewalls on opposing sides of the upper surface; and a plurality of depressions, each depression extending between adjacent spokes and from a periphery of the central region to the outer circumferential cutting edge of the cutting face; p1 wherein each spoke has a leading sidewall and a trailing sidewall and, when taken in the clockwise direction, the leading sidewall has a shorter length than the trailing sidewall.

26. The cutting element of claim 25, wherein each spoke has a leading sidewall and a trailing sidewall and, when taken in the clockwise direction, the leading sidewall has a longer length than the trailing sidewall.

27. The cutting element of claim 25, wherein the sidewalls of each of the spokes are not mirror images of each other.

28. The cutting element of claim 25, wherein at least one of the sidewalls is convex.

29. The cutting element of claim 25, wherein at least one of the sidewalls is concave.

30. The cutting element of claim 25, wherein the upper surface of each spoke is substantially co-planar continuous with the central region.

31. The cutting element of claim 25, comprising at least four spokes spaced apart on the cutting face, wherein each of the at least four spokes are continuous and co-planar with the central region.

* * * * *